United States Patent [19]

Morimoto

[11] 4,440,309

[45] Apr. 3, 1984

[54] HERMETICAL STOPPER FOR LIQUID RECEPTACLE

[75] Inventor: Tsuyoshi Morimoto, Osaka, Japan

[73] Assignee: Totoku Co., Ltd., Osaka, Japan

[21] Appl. No.: 434,897

[22] Filed: Oct. 18, 1982

[30] Foreign Application Priority Data

Oct. 22, 1981 [JP] Japan ..... 56-157778[U]

[51] Int. Cl.[3] ..... B65D 53/00

[52] U.S. Cl. ..... 220/235; 215/360; 220/237

[58] Field of Search ..... 220/235, 237; 215/360

[56] References Cited

U.S. PATENT DOCUMENTS 2,800,242 7/1957 Sauthoff ..... 220/235

4,286,139 8/1981 Taylor ..... 220/235

*Primary Examiner*—George T. Hall

*Attorney, Agent, or Firm*—Trexler, Bushnell & Wolters, Ltd.

[57] ABSTRACT

A hermetical stopper used for liquid receptacles made of aluminum including minicasks of beer. Unlike the case in conventional receptacles in which the discharge ports usually have been hermetically sealed with aluminum as the same material for the main body, the hermetical stopper according to this invention is made independently of the main body so as to be able to put into and pull from out the discharge port at will, so that it is possible to be used repeatedly keeping the hermetically sealed state even after the primary use because of the discharge port being not necessary to be cut off purposely from the main body at the time of broaching the receptacle. In this way, this hermetical stopper according to the invention is very commendable also from the point of view of the effective use of resources.

3 Claims, 4 Drawing Figures

HERMETICAL STOPPER FOR LIQUID RECEPTACLE

BACKGROUND OF THE INVENTION

This invention relates to a hermetical stopper for a minicask of beer and further any such a liquid receptacle being equipped with a discharge port.

Recently, minicasks made of aluminum for draft beer come into the market and win popularity. Receptacles of beer requires a very high-degree airtightness. Accordingly, it is impossible to attain such a degree of sealability by means of using commonplace stoppers. A liquid receptacle of this type is usually made by sealing the discharge port with aluminum as the same material for the main body. In broaching such a receptacle, it is an accepted way of doing to cut off the portion of the discharge port. However, a means like this has a disadvantage that the recetpacle which has been opened in such a manner can not be provided for its reuse in the state as it was even if being stoppered after the primary use, the reason for which is because it becomes impossible to close tightly anew the receptacle having been once opened.

SUMMARY OF THE INVENTION

Under such circumstances as above, the present invention has for its object the provision a hermetical stopper, of an excellent sealing effect, being used for the minicask of beer and further any such a liquid receptacle equipped with a discharge port.

Another object of this invention is to provide a hermetical stopper being used for a liquid receptacle by the use of which it is made possible to obtain again the hermetically sealed state same as before even after having once opened.

A further object of this invention is to provide a hermetical stopper which, in the case of a receptacle formed of aluminum and equipped with a discharge port, is possible to be hermetically sealed again in the same manner after having been once opened, and consequently which is possible to be repeatedly used in the hermetically sealed state same as before even after its primary use.

Still a further object of this invention is to provide a hermetical stopper for a liquid receptacle by means of which it is possible to reuse the receptacle made of aluminum and equipped with a discharge port while keeping the sealing effect same as before again even after having been opened, thereby being able to the effective use of resources.

An additional object of this invention is to provide a hermetical stopper for a liquid receptacle wherein a perfect state of hermetical sealability can be obtained only by turning an operationg means attached to the main body of the stopper which is inserted into the discharge port of the liquid receptacle, whereby the receptacle can be sealed completely by a simple operation.

BRIEF DESCRIPTION OF DRAWINGS

Other objects of the invention and advantages able to be attained in accordance therewith will be more clearly understood from the following description with reference to the accompanying drawings, in which.

DETAILED DESCRIPTION

Figure 1:
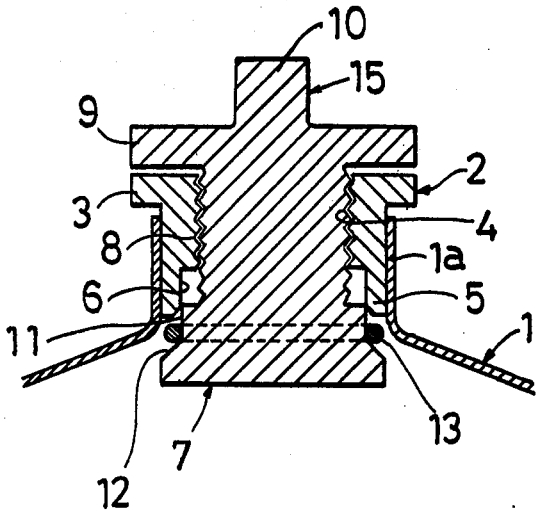
FIG. 1 is a vertical sectional view of the principal part of the hermetical stopper according to the invention showing a state where the stopper has been inserted into the discharge port of the receptacle, but it is not yet tightly sealed thereat.

In FIG. 1, reference numeral (1*a*) indicates a cylindrical discharge port of a liquid receptacle (1) made of aluminum. Into this discharge port (1*a*) is inserted the main body (2) of the stopper. This main body (2) of the stopper is a cylinder which is formed on its upper end part into a flange (3), is threaded on its inner circumference with a female screw (4), and has a large diametral inner circumferential part (6) which is opened toward the side of its bottom part (5). Numeral (7) indicates a holding member which is screwed on the female screw (4) of the main body (2) of the stopper through the medium of its own male screw (8). This holding member (7) projects over the main body (2) of the stopper. On the projecting part of this holding member (7) is provided a flange (9) facing to the foregoing flange (3) of the main body (2) of the stopper. On the top face of this flange (9) is integrally formed a knob (10) as an anxiliary of the operating means (15).

On the other hand, the lower end part of the holding member (7) is formed into a large diametral outer circumferential part (11) which enters and leaves the interior of the above-mentioned large diametral inner circumferential part (6) of the main body (2) of the stopper, and further, continuing to this large diametral outer circumferential part (11) and on the lower part of it, a tapered outer circumferential part (12) growing downwards in large diameter is formed, while an O ring (13) for sealing is fitted on the outer circumferential part of the holding member (7) being composed of both the large diametral outer circumferential part (11) and the tapered outer circumferential part (12) from outside below the lowermost part of the main body (2) of the stopper.

Figure 2:
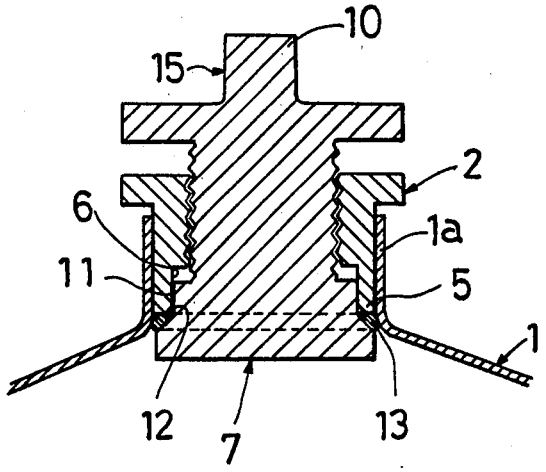
FIG. 2 is a vertical sectional view showing a state of the same after having been tightly sealed.

Hereupon, when gripping the knob (10) on the upper face of the holding member (7) to rotate that holding member (7) to the one side, then the holding member (7) shifts upward through the part screwing on the main body (2) of the stopper, and thereby the O ring (13) impinges against the lowermost part (5) of the main body (2) of the stopper and at the same time is expanded and swelled outward by dint of the tapered outer circumferential part (12) to be compressed between the lowermost part (5) and the tapered part (12), so that the O ring (13) closely adheres to the inner wall face of the liquid receptacle (1), as seen in FIG. 2, whereby the hermetically sealed state of the receptacle can be achieved to perfection.

Figure 3:
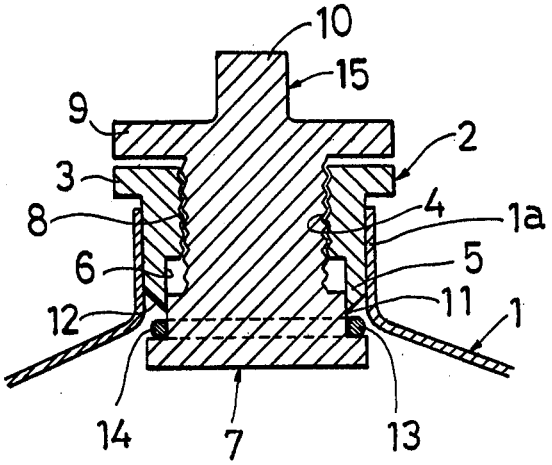
FIGS. 3 and 4 are vertical sectional views of the principal parts of two different examples according to the invention, showing their respective states of being not yet tightly sealed.

FIG. 3 shows another example according to the invention. In contrast to the example in FIG. 1, this is the one, where the tapered outer circumferential part (12) is formed in such a manner as to grow in large diameter obliquely upward from the lowermost part of the main body (2) of the stopper to the outer circumferential part thereof, while on the other hand the holding member (7) projecting below the lowermost part of the main body (2) of the stopper is formed on its own lower part into a large diameter in the form of a step part (14), whereby the O ring (13) should be made expanded and swelled outward by the cooperation of the step part (14) with the tapered circumferential part (12). Incidentally, in FIGS. 1, 2, and 3, the knob (10), the flange (9), and the holding member (7) are depicted as if being formed in one body, however, in practice, they are united each other after having been formed separately.

Figure 4:
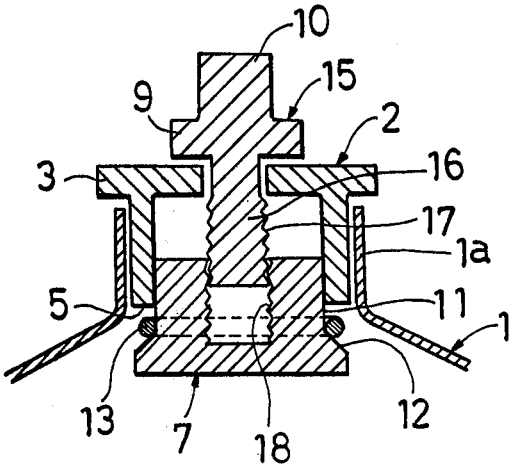

FIG. 4 shows still a further example according to the invention. In this example, the holding member (7) is made to be slidingly contacted with the main body (2) of the stopper without the medium of somewhat such as screwing-on part as in the former example, the operating means (15) provided with the knob (10) makes a shank (16) which is formed thereunder project inwardly piercing through a hollow space of the main body (2) of the stopper, and the male screw threaded on that shank (16) is made to be screwed from the upper face of the holding member (7) onto the female screw part (18) which is formed by being threaded in the interior of the cavity of the central part of the holding member (7). In this example, the tapered outer circumferential part (12) is formed on the side of the holding member (7), as in FIG. 1, however, it will do well also if that tapered part (12) is formed on the side of the main body (2) of the stopper.

While a few preferred embodiments of the invention have been described in the above, this invention is not limited thereto, but various charges and modifications may be possible within the scope as set out in the accompanying claims.

What is claimed is:

1. A hermetical stopper used for a liquid receptacle, which comprises;

providing a holding member down the bottom of the main body of said stopper which is to be inserted into the discharge port of said receptacle, said holding member projecting below said main body and being made to shift in the direction of entering and leaving said main body by the action of an operating means being located on the upperside of said main body;

mounting an O ring externally on the outer circumference of the projecting part of said holding member; and making said O ring swell outward by the shifting movement of said holding member to the side of said main body, whereby said O ring is made to closely adhere to the inner wall of said liquid receptacle.

2. A hermetical stopper used for a liquid receptacle as set forth in claim 1, wherein a female screw part is formed on the inner circumferential part of a cylinder-shaped main body of a stopper, a male screw part of a holding member is made to screw on said femal screw part from the side of the bottom of said main body, an operating means for rotatating said male screw part is formed by being made to project over said main body, and either of the lowermost part of said main body and the wall face of said holding member facing said lowermost part of said main body is formed into a tapered outer circumferential part onto which an O ring runs.

3. A hermetical stopper used for a liquid receptacle as set forth in claim 1, wherein a shank being formed continuously from the under part of said operating member is made to project inwardly piercing through said main body of the stopper, and a screw being formed on said shank is made to screw on said holding member.

* * * * *